US005094507A

United States Patent [19]

Gibbs

[11] Patent Number: 5,094,507

[45] Date of Patent: Mar. 10, 1992

[54] KNOCK-DOWN AND STACKABLE CHAIRS HAVING REPLACEABLE SIDE FRAME INSERTS

[75] Inventor: Terence Gibbs, Nyack, N.Y.

[73] Assignee: Omni Products International, Inc., Fairfield, N.J.

[21] Appl. No.: 612,093

[22] Filed: Nov. 9, 1990

[51] Int. Cl.[5] ..... A47C 3/04

[52] U.S. Cl. ..... 297/239; 297/440; 297/445

[58] Field of Search ..... 297/440, 445, 239, DIG. 2

[56] References Cited

U.S. PATENT DOCUMENTS

| | | | |
|---|---|---|---|
| 3,380,778 | 4/1968 | Bareki | 297/239 X |
| 3,497,262 | 2/1970 | Piretti et al. | 297/239 |
| 4,815,180 | 3/1989 | Elsener | 24/616 |
| 4,997,234 | 3/1991 | Royle et al. | 297/440 X |

FOREIGN PATENT DOCUMENTS

| | | | |
|---|---|---|---|
| 529845 | 3/1955 | Italy | 297/445 |
| 8303967 | 3/1985 | Netherlands | 297/239 |

*Primary Examiner*—Laurie K. Cranmer

*Attorney, Agent, or Firm*—Lerner, David, Littenberg, Krumholz & Mentlik

[57] ABSTRACT

Knock-down and stackable light-weight chairs of plastic and welded aluminum construction having replaceable side frame decorative inserts are disclosed. In knock-down chairs, decorative inserts which are releasably lockable to the side frames prevent their inadvertent removal during use to prevent loss or damage. In chairs constructed of welded aluminum, the removable decorative inserts enable stacking of plural chairs shipping in a single carton, as well as minimizing storage space by the ultimate user.

20 Claims, 5 Drawing Sheets

KNOCK-DOWN AND STACKABLE CHAIRS HAVING REPLACEABLE SIDE FRAME INSERTS

BACKGROUND OF THE INVENTION

The present invention relates in general to new and useful improvements in light-weight casual lawn furniture, and more particularly, to knock-down and stackable chairs of light-weight plastic and aluminum material having supporting side frames with removable decorative inserts.

Casual outdoor lawn furniture is available in a wide variety of styles and manufactured from a variety of materials. In producing lawn furniture, it is desirable to select materials which are impervious to the weather such that the furniture will not rot, rust, corrode, etc., are readily available, and which are suitable for mass production techniques. Of the known materials, rigid plastic such as polyvinylchloride and aluminum have been extremely popular. These materials have the additional advantage of being light-weight such that the resulting lawn furniture may be easily moved and stored. Lawn furniture constructed from reinforced plastic material is known, for example, from Schwartz et al., U.S. Pat. No. 4,762,368.

Lawn furniture of plastic material is typically of knock-down construction enabling the furniture to be shipped unassembled in cartons to the retailer and conveniently carried by the ultimate purchaser to one's home for assembly. Casual furniture of this type, such as chairs and chaise lounges, are known to be constructed from a pair of spaced side frames to which there is attached the main body supporting portion of the chair or chaise lounge. In order to enhance the aesthetic and ornamental appeal of such casual furniture, decorative inserts are removably secured to the side frames. These inserts are generally in the nature of spokes arranged in various patterns having their opposing ends extending into openings within the side frames. Although this construction enables easy installation of the spokes, it also enables easy inadvertent removal of the spokes from the side frames. As a result, the spokes once inadvertently removed can become damaged or lost necessitating their replacement in order to maintain the aesthetic appearance of the casual furniture. One can therefore appreciate that there is a need for the construction of casual furniture having decorative inserts whose construction prohibits the inserts from being inadvertently removed to prevent damage or loss thereof.

Similar type decorative inserts constructed of spokes or other forms are employed in the design of casual furniture constructed from aluminum. Typically, aluminum casual furniture are of welded construction and do not possess the characteristic knock-down feature known from casual furniture constructed from plastic material. The welding of the inserts to the side frames avoids their inadvertent removal and insures the integrity of the furniture.

As the welded aluminum furniture must, of necessity, be shipped fully constructed, it is desirable for space saving to enable stacking of a plurality of items of lawn furniture such as chairs for shipment in a single carton. This cannot be achieved with casual furniture having fixed decorative inserts which interfere with their ability to be stacked and therefore necessitate their singular shipment. Here again, there is a need for casual welded aluminum furniture having removable decorative inserts which enable stacking of the furniture to facilitate shipment in single cartons, as well as storage by the ultimate consumer.

It is therefore an object of the present invention to provide knock-down and stackable chairs having replaceable side frame inserts that avoids some of the foregoing disadvantages of prior casual lawn furniture.

Another object of the present invention is to provide knock-down light-weight casual lawn furniture constructed of reinforced plastic material having replaceable decorative side frame inserts which are constructed to inhibit their removability once installed.

Another object of the present invention is to provide a light-weight casual lawn furniture constructed of aluminum having removable decorative side frame inserts to enable stacking of plural chairs during shipment in single cartons and during storage by the end user.

Further objects and advantages of the present invention will become apparent as the following description proceeds.

SUMMARY OF THE INVENTION

Briefly stated, in accordance with one embodiment of the present invention, there is provided a chair comprising first and second spaced side frames each having spaced openings, seat means for forming a body supporting portion of the chair carried by and attached between the side frames, a pair of inserts removably secured to respective ones of the side frames, the inserts having opposed ends extending into the spaced openings of respective ones of the side frames, at least one end of the inserts having a notch for releasably engaging a side frame adjacent the opening.

In accordance with another embodiment of the present invention there is provided a chair comprising first and second spaced side frames each having a pair of spaced openings arranged at spaced locations, seat means for forming a body supporting portion of the chair carried by and attached between the side frames, at least a pair of inserts removably secured to respective ones of the side frames, the inserts including opposed ends supporting spaced projections having a center-to-center dimension greater than the center-to-center dimension of the pair of spaced openings, the projections extendable into the pair of spaced openings of respective ones of the side frames upon the projections being positioned having their center-to-center dimension substantially corresponding to the center-to-center dimension of the pair of spaced openings, the projections having a notch releasably engaging a side frame adjacent the pair of spaced openings upon the projections being positioned having their center-to-center dimension greater than the center-to-center dimension of the pair of spaced openings.

In accordance with still another embodiment of the present invention, there is provided a chair constructed to be stackable with a chair of the same construction comprising first and second spaced side frames each having spaced openings, seat means for forming a body supporting portion of the chair carried by and attached between the side frames, a pair of inserts removably secured to respective ones of the side frames by having opposed ends extending into the spaced openings of respective ones of the side frames, the chair upon removing the inserts from the side frames stackable upon another the chair whereby the seat means and the side frames of respective chairs are arranged adjacent each other in overlying relationship.

BRIEF DESCRIPTION OF THE DRAWINGS

The above description, as well as further objects, features and advantages of the present invention will be more fully understood with reference to the following detailed description of knock-down and stackable chairs having replaceable side frame inserts, when taken in conjunction with the accompanying drawings, wherein.

DETAILED DESCRIPTION

Figure 1:
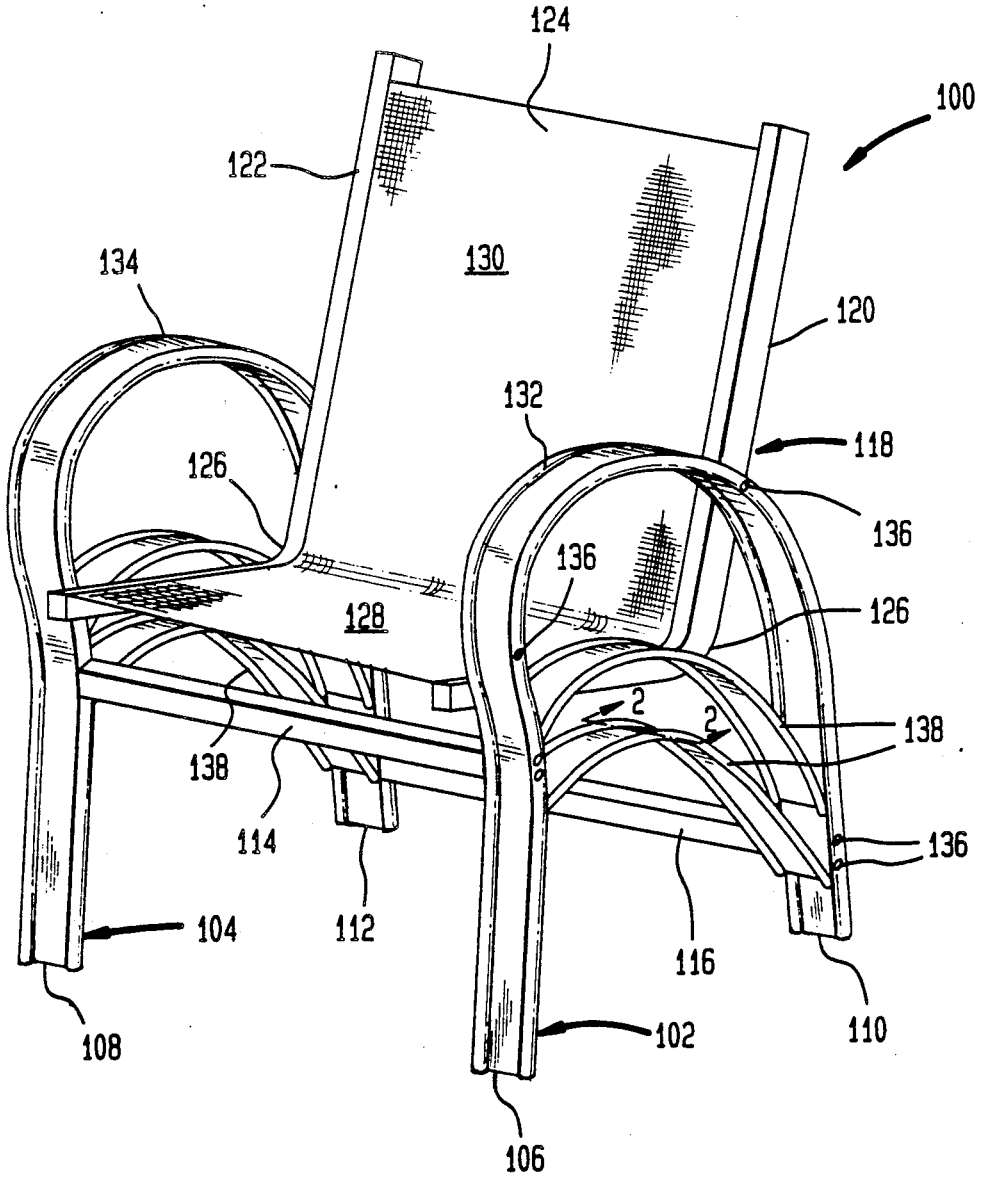
FIG. 1 is a perspective view of a light-weight chair of knock-down construction having a pair of side frames to which there is removably attached a seat support and a plurality of decorative inserts in accordance with the present invention.

Referring now to the drawings wherein like reference numbers represent like elements, there is shown in FIG. 1 an item of light-weight casual outdoor lawn furniture in the nature of a chair designated generally by reference number 100. The chair 100 includes first and second transversely spaced side frames 102 and 104 which form front legs 106 and 108 and rear legs 110 and 112. The front legs 106 and 108 are rigidly interconnected by a forward transverse cross brace 114, while the rear legs 110 and 112 are rigidly interconnected by a rearward transverse cross brace 116. A chair seat section 118 is provided with first and second transversely spaced seat side support members 120 and 122 which are attached to the side frames 102 and 104. A seat forming member 124 constructed, for example, of a conventional open mesh fabric or other suitable flexible material such as strapping, extends between the seat side support members 120 and 122 in accordance with known practice.

The seat side support members 120 and 122 are each provided a bends as shown at 126, so that the seat forming member 124 includes a seat portion 128 and a back rest support portion 130. Arm rests 132 and 134 are formed as part of the side frames 102 and 104, and more particularly, as extensions between the front legs 106 and 108 and rear legs 110 and 112. The upper rear portions and lower front portions of the arm rests 132 and 134 are fixed respectively to the back rest portion 130 and seat portion 128 of the seat side support members 120 and 122 by suitable fastening means such as at 136. Similarly, the front legs 106 and 108 are fixed to cross brace 114 and rear legs 110 and 112 are fixed to cross brace 116 by similar fastening means 136. Fastening means 136 suitable to provide the fixed interconnections as thus far described are disclosed in Schwartz et al., U.S. Pat. No. 4 762 368 and Poo U.S. Pat. No. 4,826,248.

As thus far described, it is to be understood that the chair 100 is of knock-down construction by having the side frames 102 and 104, cross braces 114 and 116 and seat section 118 assemblable by the fastening means 136. Thus, the chair 100 may be shipped unassembled thereby occupying a minimum shipping volume within a suitable container which may contain the components for more than one chair. The rigidity and mechanical strength of the chair 100 may be increased by constructing the side frames 102 and 104 and the cross braces 114 and 116 from reinforced, multiple chambered plastic extrusions such as known from Schwartz et al., U.S. Pat. No. 4,726,368.

Figure 2:
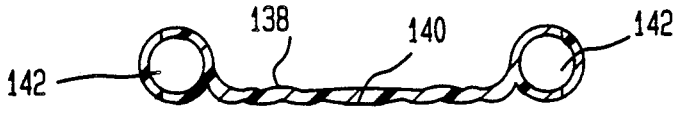
FIG. 2 is a cross-sectional view taken along line 2—2 in FIG. 1 showing the construction of one example of a decorative insert designed for use with a chair constructed in accordance with the present invention.

In order to enhance the aesthetic and ornamental appeal of the chair 100, one or more decorative side frame inserts 138 are attached to the side frames 102 and 104 between the front legs 106 and 108 and rear legs 110 and 112. One example of a decorative insert 138 is further shown in FIGS. 2 and 3. The insert 138 is constructed as a longitudinally-extending member having a generally flat central web 140 extending between parallel spaced co-extensive hollow tubular members 142. At the opposite ends of the insert 138, the tubular members 142 extend outwardly beyond the extent of web 140 as generally designated at 144 in the form of tubular projections 146. Each tubular projection 146 is provided with an outwardly facing notch 148 having a generally rectangular profile. The insert 138 is constructed of suitable plastic material, and in addition, by virtue of the web 140 has a certain degree of resiliency. This resiliency enables the insert 138 to be flexed into the curved shape as shown in FIG. 1, as well as allowing transverse contraction between the tubular members 142 as to be described hereinafter.

Figure 3:
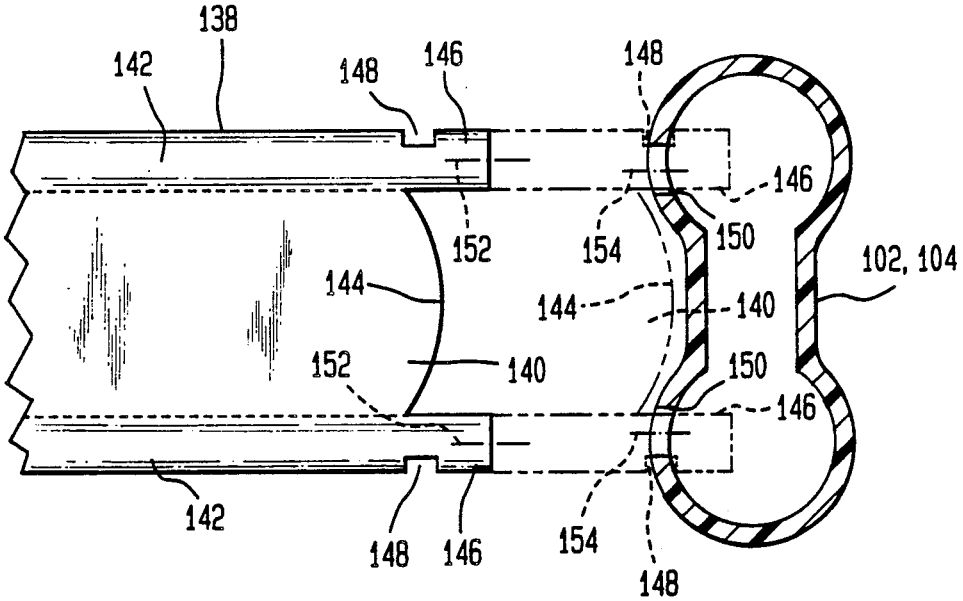
FIG. 3 is an unassembled top plan view, in partial cross-section, of a decorative insert constructed for re engaging the side frame as shown in dashed lines.

As most clearly shown in FIG. 3, the side frames 102 and 104 are provided with a pair of spaced apart openings 150 sized and shaped to receive the tubular projections 146 provided on opposite ends of the insert 138. As illustrated, the center-to-center spacing between the center lines 152 of the tubular projections 146 is slightly greater than the center-to-center spacing between the center lines 154 of openings 150. The increased spacing may be in the order of a few millimeters, for example, in the order of 4 to 8 millimeters.

The inserts 138 are secured to the side frames 102 and 104 by first transversely squeezing each insert end to reduce the center-to-center distance between center lines 152 so as to correspond to the center-to-center distance between center lines 154 of openings 150. This ability to deform the insert 138 is a result of the resilient nature of the insert resulting from its construction of plastic material and the flexibility of web 140. The tubular projections 146 are inserted through openings 150 until notches 148 are positioned facing a portion of the surrounding side wall forming the opening. Upon release of the insert 138, its resilient nature causes the projections 146 to expand outwardly so as to assume or approach their original center-to-center spacing. As clearly shown by the dashed lines, this results in the notches 148 capturing a portion of the surrounding wall forming the openings 150.

Figure 4:
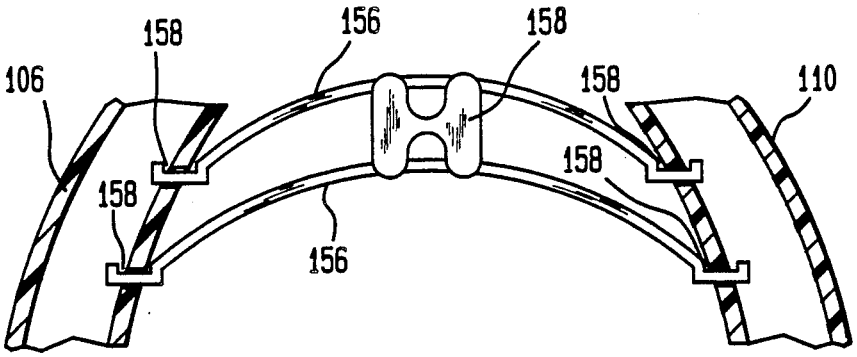
FIG. 4 is a side elevational view in partial cross-section showing another example of a decorative insert designed for use with a chair constructed in accordance with the present invention.

As thus far described, the inserts 138 are now releasably locked into assembled relationship within the side frames 102 and 104. This locking of the inserts 138 prevents their inadvertent removal during use which might otherwise result in the inserts being broken or ultimately lost. At the same time, the foregoing construction of the inserts 138 enables the chair 100 to be shipped with the inserts unassembled and later, securely locked in place by the ultimate user. Although the invention herein has been described with reference to the particular decorative shape of insert 138, it is to be understood that other such inserts having a different decorative shape may be employed in accordance with the present invention. For example, as shown in FIG. 4, one or more decorative inserts 156 in the nature of longitudinally-extending members having round, flat, oval or rectangular cross-sections are provided with notches 158 at opposite ends thereof. The notches 158 are engaged within openings formed within front legs 106 and rear legs 110 to prevent inadvertent removal of the inserts 156. The resilient nature of the inserts 156 enable their flexing into an arcuate shape which results in the creation of a spring force for maintaining the inserts 156 in their locked position. Optionally, a decorative connecting member 158 may join the inserts 156 to change the ornamental appearance of the resulting chair.

Figure 5:
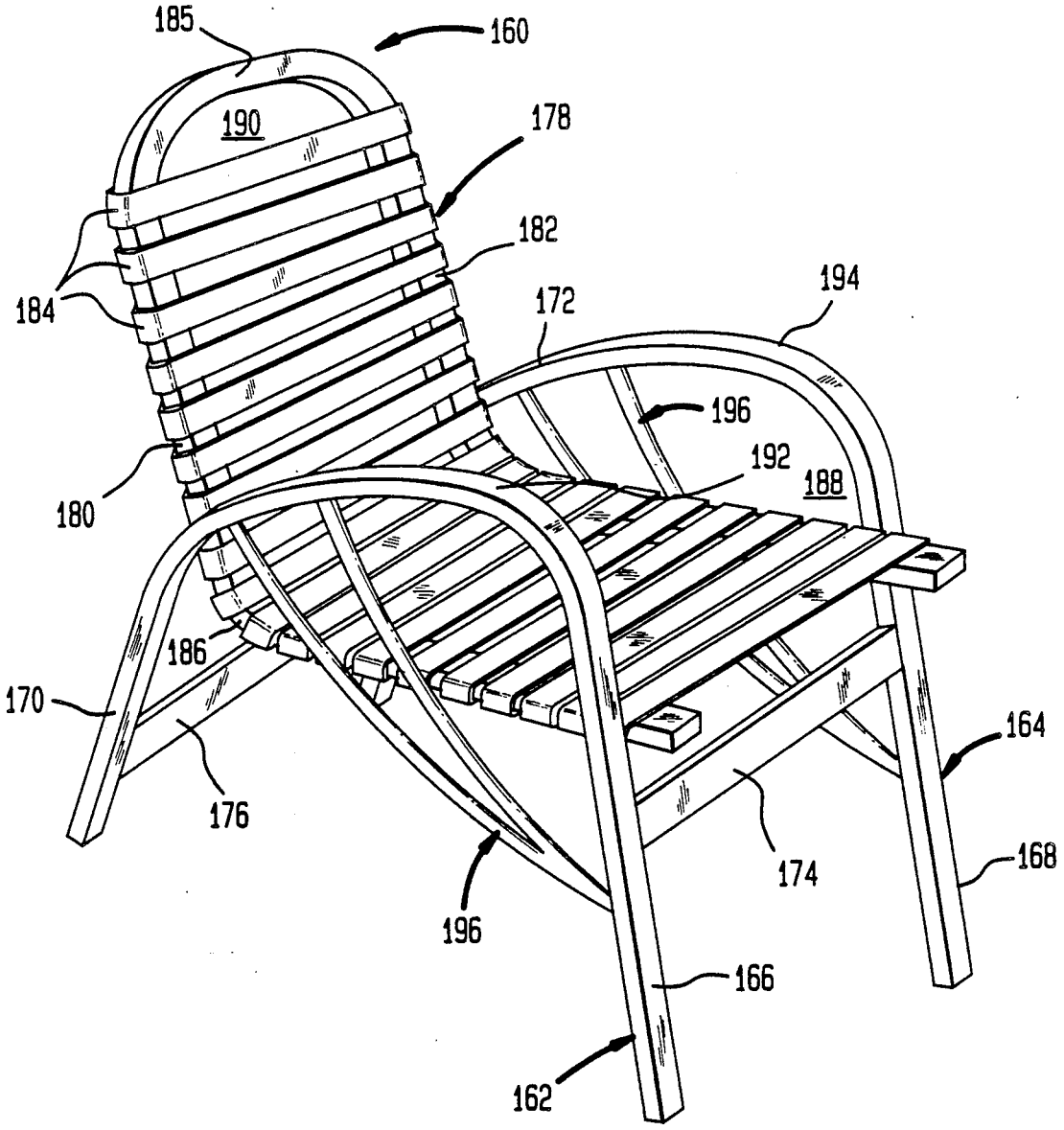
FIG. 5 is a perspective view of a light-weight chair of welded aluminum construction having a pair of side frames to which there is permanently attached a seat support and a removable decorative insert to enable stacking of like in a compact arrangement.

Turning now to FIG. 5, there is shown a light-weight chair 160 of welded aluminum construction. The chair 160 includes first and second transversely spaced side frames 162 and 164 which form front legs 166 and 168 and rear legs 170 and 172. The front legs 166 and 168 are rigidly interconnected by a forward transverse cross brace 174, while the rear legs 170 and 172 are rigidly interconnected by a rearward transverse cross brace 176. A chair seat section 178 is provided with first and second transversely space seat side support members 180 and 182 which are attached to the side frames 162 and 164. A seat forming member 184 constructed, for example, of strapping or other suitable flexible material such as conventional open mesh fabric, extends between the seat side support members 180, 182 in accordance with known practice. The seat side support members 180 and 182 are integrally joined in U-shape by top cross member 185 and each provided with a bend, as shown at 186, so that the seat forming member 184 includes a seat portion 188 and a back rest support portion 190. Arm rests 192 and 194 are formed as part of the side frames 162 and 164, and more particularly, as extensions between the front legs 166 and 168 and rear legs 170 and 172.

The side frames 162 and 164, seat side support members 180 and 182 and cross braces 174 and 176 are constructed from extruded aluminum which may be internally reinforced in the manner as disclosed in Schwartz et al., U.S. Pat. No. 4,762,368. The upper rear portions and lower front portions of the arm rests 192 and 194 are permanently fixed respectively to the back rest portion 190 and seat portion 188 of the seat side support members 180 and 182 by suitable means such as by welding or brazing. Similarly, the front legs 166 and 168 are fixed to cross brace 174 and rear legs 170 and 172 are fixed to cross brace 176 by similar welding or brazing. The resulting chair 160 has a rigid construction suitable for light-weight casual lawn furniture.

Figure 6:
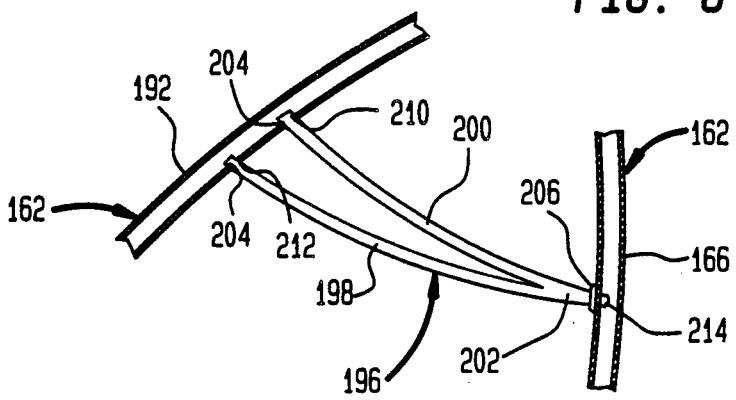
FIG. 6 is a front elevational view, in partial cross-section, showing the construction of an aluminum decorative insert removably attached to the side frame of a welded aluminum chair.

Once again, in order to enhance the aesthetic and ornamental appeal of the chair 160, one or more decorative side frame inserts 196 are attached to the side frames 162 and 164 between the front legs 166 and 168 and rear legs 170 and 172. One example of a decorative insert 198 is further shown in FIG. 6. The insert 196 is constructed as a Y-shaped member including a pair of diverging members 198 and 200 integrally joined to a single common member 202. The diverging members 198 and 200 and common member 202 may be of a variety of cross-sectional shapes, for example, flat, oval, cylindrical and the like and as with inserts 136 may have either smooth or decorative outer surfaces such as fluting, stippling and the like. The free ends of the diverging members 198 and 200 are provided with outwardly facing notches 204. The free end of the common member 208 is provided with a surrounding plastic cap 206. Like the other components of the chair 160, the inserts 196 may be constructed of aluminum.

The arm rests 192 and 194 formed from the side frames 162 and 164 are provided with a pair of spaced openings 210 and 212 sized and shaped to receive the free ends of the diverging members 198 and 200 of the insert 196. The front legs 166 and 168 of the side frames 162 and 164 are provided with a single opening 214 sized and shaped to receive the free end of the common member 202. The decorative insert 196 is releasably locked into the side frames 162 and 164 upon engagement of the notches 204 with a portion of the side wall forming the openings 210 and 212. The cap 206 is designed to be received partially within the opening 214 to function as a grommet and to enhance the formation of a flexible yet rigid interconnection between the common member 202 of the insert 196 and the side frames 162 and 164.

The release locking of the free ends of the diverging members 198 and 200 to the side frames 162 and 164 via use of the notches 204 may be achieved in a number of ways. For example, although the insert 196 is constructed of aluminum, the diverging nature of the members 198 and 200 from the common member 202 provides these members with a certain degree of resiliency enabling the ability to reduce their center-to-center dimension at their free ends in a manner similar to the insert 138 described with respect to FIG. 1. The diverging members 198 and 200 can accordingly be releasably locked to the side frames 162 and 164 as the members are naturally spread apart once the previously applied force to reduce their center-to-center dimension has been removed. Alternatively, the notches 204 may be sized to provide a friction fit in engaging a portion of the side frames 162 and 164 to secure the inserts 196 thereto.

In an alternative arrangement, the longitudinal nature of the diverging members 198 and 200, despite their construction of aluminum, result in a certain degree of flexibility and resiliency. The longitudinal length of the insert 196 between notches 204 and cap 206 is designed to be slightly longer than the arcuate path the insert will follow between the openings 210 and 212 and opening 214 within the side frames 162 and 164. This arrangement will initially cause the free ends of the diverging members 198 and 200 to extend through the openings 210 and 212 such that the notches 204 are not in alignment with the openings but are slightly displaced inwardly within the interior of the side frames 162 and 164. In order to effect locking engagement of the notches 204, it is necessary to slightly bias the insert 196 under compression so as to decrease its effective radius of curvature and thereby shortening its effective length to enable engagement of the notches with the side frames 162 and 164. The resulting tension created within the insert 196 will forcibly maintain the insert in lockably releasable position within the side frames 162 and 164.

Figure 8:
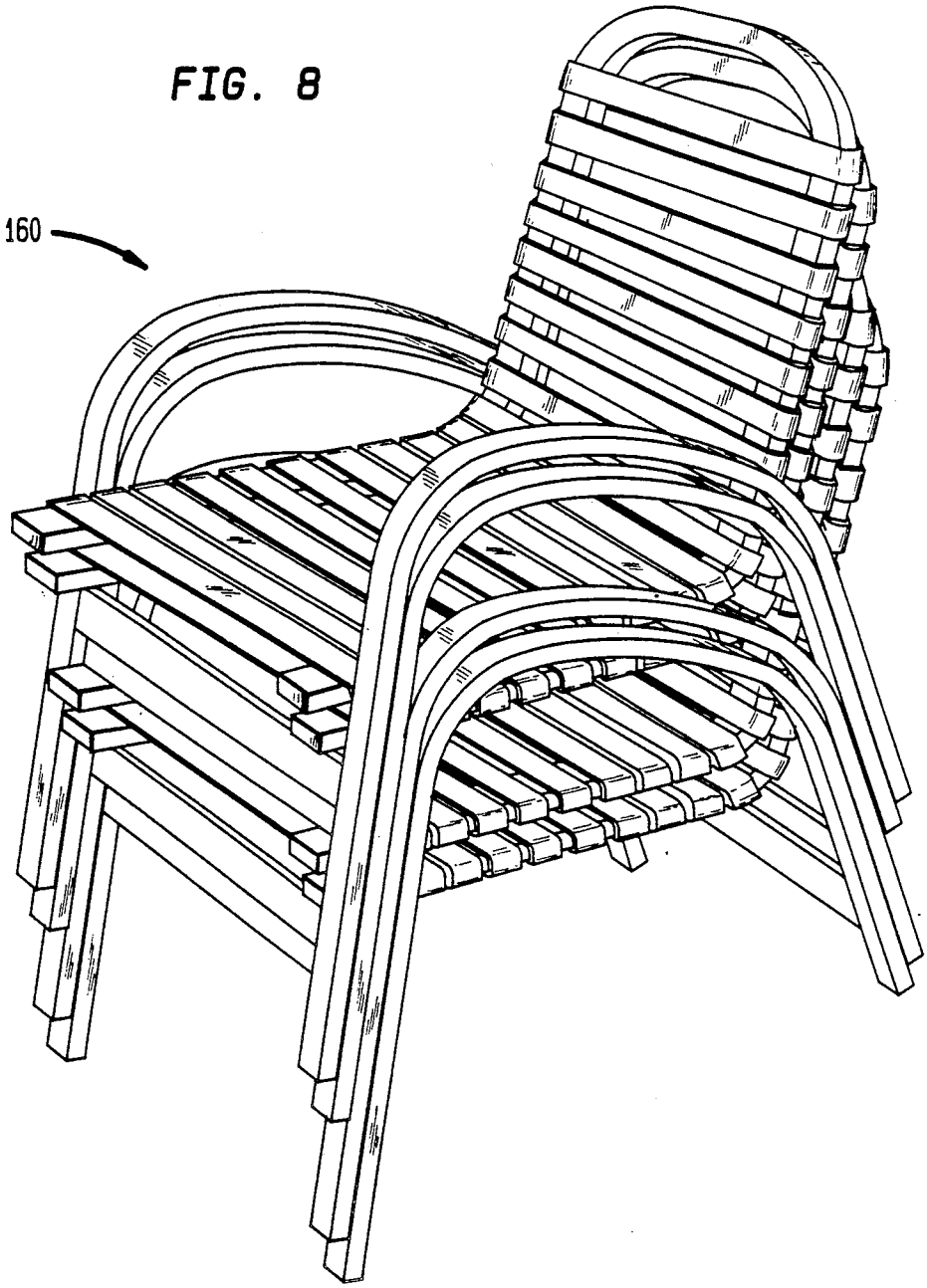
FIG. 8 is a perspective view of a plurality of light-weight chairs of aluminum welded construction in stacked arrangement having removable decorative side frame inserts in accordance with the present invention removed to enable their stacking.
Figure 7:
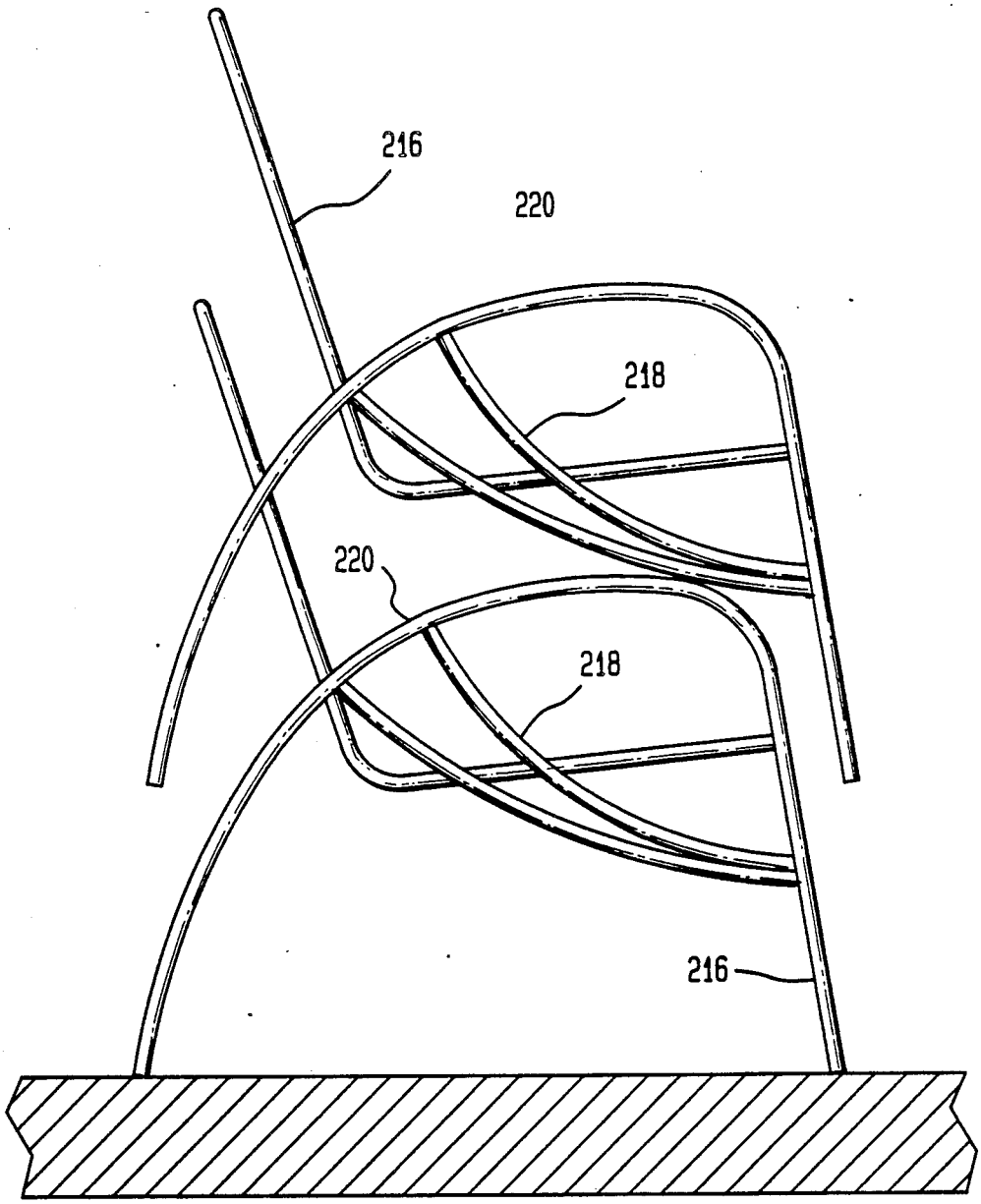
FIG. 7 is a side elevational view of a prior known light-weight chair of welded aluminum construction having non-removable decorative inserts which prohibit stacking of like chairs in a composite arrangement.

As previously described, it is desirable in the construction of light-weight casual furniture from aluminum to enable their stacking one upon the other to facilitate shipping and storage. Referring to FIG. 7, there is shown a chair 216 of similar construction to chair 160 as shown in FIG. 5. The chair 216 is also of welded aluminum construction and is provided with decorative inserts 218 which are non-removable, by virtue of being welded or brazed in fixed permanent position. In attempting to stack one chair 216 upon another chair, the inserts 218 are engaged by the side frame 220 of an underlying chair 216 to prevent the nestling in stacked relationship. It is therefore necessary that these chairs 216 be singularly shipped in individual cartons and subsequently stored by the user in individual locations. On the other hand, in accordance with the present invention as shown in FIG. 8, once the decorative inserts 196 have been removed from within the side frames 162 and 164, the chairs may be nestled in stacked relationship to enable shipment of multiple chairs in a single carton and to facilitate storage by the user. As shown, the stacked chairs 160 are arranged one above the other such that their respective side frames 162 and 164 overlie adjacently one another as well as their respective seat sections 178.

Although the invention herein has been described with references to particular embodiments, it is to be understood that these embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. An assembled chair comprising first and second spaced side frames each having an outwardly facing surface and an inwardly facing surface, said first and second side frames each having spaced openings within said inwardly facing surface, seat means for forming a body supporting portion of said chair carried by and attached between said side frames, a pair of inserts removably secured to respective ones of said side frames, said inserts arranged opposing said inwardly facing surface of said side frames, said inserts having opposed ends extending into said spaced openings of respective ones of said side frames such that the inserts lie in a respective plane containing a side frame, at least one end of said inserts having a notch for releasably and engaging the inwardly facing surface of said side frame adjacent said opening, said seat means remaining attached to said side frames independent of said inserts.

2. The chair of claim 1, wherein said side frames each include a pair of spaced openings arranged at spaced locations, and said opposed ends of said inserts include a pair of spaced projections extending into said pair of spaced openings, said projections have a said notch for releasably engaging a side frame.

3. The chair of claim 2, wherein the center-to-center dimension of said pair of spaced openings is less than the center-to-center dimension of said projections.

4. The chair of claim 1, wherein said inserts comprise a plurality of elongated members.

5. The chair of claim 4, wherein said members comprise a web having transversely spaced longitudinally co-extensive tubular members.

6. The chair of claim 1, wherein said side frames form front and rear legs of said chair.

7. The chair of claim 6, wherein said side frames further form arm rests of said chair.

8. A chair comprising first and second spaced side frames each having a pair of spaced openings arranged at spaced locations, seat means for forming a body supporting portion of said chair carried by and attached between said side frames, at least a pair of inserts removably secured to respective ones of said side frames, said inserts including opposed ends supporting spaced projections having a center-to-center dimension greater than the center-to-center dimension of said pair of spaced openings, said projections extendable into said pair of spaced openings of respective ones of said side frames upon said projections being positioned having their center-to-center dimension substantially corresponding to the center-to-center dimension of said pair of spaced openings, said projections having a notch releasably engaging a side frame adjacent said pair of spaced openings upon said projections being positioned having their center-to-center dimension greater than the center-to-center dimension of said pair of spaced openings.

9. The chair of claim 8, wherein said chair is constructed of plastic material.

10. The chair of claim 8, wherein said side frames form the front and rear legs of said chair.

11. The chair of claim 10, wherein said side frames further form arm rests of said chair.

12. The chair of claim 8, wherein said inserts comprise a plurality of longitudinally-extending members.

13. The chair of claim 12, wherein said members comprise a web having transversely spaced longitudinally co-extensive tubular members, said tubular members forming said projections.

14. The chair of claim 8, wherein said notches at a common end of said inserts are arranged outwardly facing with respect to each other.

15. An assembled metal chair constructed to be stackable with an assembled chair of the same construction comprising first and second spaced side frames each having lateral facing surfaces, an outwardly facing surface and an inwardly facing surface, said first and second spaced side frames arranged in a respective plane having said lateral facing surfaces opposing one another and each having spaced openings within said inwardly facing surface, seat means for forming a body supporting portion of said chair carried by and non-removably attached between said side frames, inserts removably secured to respective ones of said side frames by having opposed ends extending into said spaced openings of respective ones of said side frames, said inserts arranged opposing said inwardly facing surface within a respective plane containing said first and second spaced side frame, said chair upon removing said insets from said side frames stackable upon another said chair whereby said seat means and said side frames of respective chairs are aranged adjacent each other in overlying relationship.

16. The chair of claim 15, wherein said chair is constructed of aluminum.

17. The chair of claim 15, wherein said side frames form the front and rear legs of said chair.

18. The chair of claim 17, wherein said side frames further form arm rests of said chair.

19. The chair of claim 15, wherein said inserts have a Y-shape profile.

20. The chair of claim 15, wherein said seat means is welded to said side frames.

* * * * *

UNITED STATES PATENT AND TRADEMARK OFFICE

CERTIFICATE OF CORRECTION

PATENT NO. : 5,094,507

DATED : March 10, 1992

INVENTOR(S) : TERENCE GIBBS

It is certified that error appears in the above-identified patent and that said Letters Patent is hereby corrected as shown below:

Column 3, line 19, "re" should read --releasably--.
Column 8, line 67, "aranged" should read --arranged--.

Signed and Sealed this

First Day of June, 1993

*Attest:*

Michael K. Kirk

MICHAEL K. KIRK

*Attesting Officer*

*Acting Commissioner of Patents and Trademarks*